US006631855B2

(12) United States Patent
Huang

(10) Patent No.: US 6,631,855 B2
(45) Date of Patent: Oct. 14, 2003

(54) STRUCTURALLY IMPROVED SPRAY GUN

(76) Inventor: Jung-kun Huang, P.O. Box 697, Feng-Yuan City 420 (TW)

( * ) Notice: Subject to any disclaimer, the term of this patent is extended or adjusted under 35 U.S.C. 154(b) by 107 days.

(21) Appl. No.: 09/853,995

(22) Filed: May 10, 2001

(65) Prior Publication Data

US 2002/0166905 A1 Nov. 14, 2002

(51) Int. Cl.[7] ..... B05B 7/02; B05B 9/01; B05B 11/02; A62C 13/62; A62C 13/66

(52) U.S. Cl. ..... 239/526; 239/302; 239/320; 239/321

(58) Field of Search ..... 239/526, 302, 239/320, 321, 333, 354, 359, 375, 378, DIG. 14, 569, 581.2, 582.1, 583, 585.1; 222/333, 183, 105, 107, 108

(56) References Cited

U.S. PATENT DOCUMENTS

| | | | | | |
|---|---|---|---|---|---|
| 3,899,134 | A | * | 8/1975 | Wagner | 239/332 |
| 5,282,722 | A | * | 2/1994 | Beatty | 417/15 |
| 5,320,280 | A | * | 6/1994 | Murphy et al. | 239/126 |
| 5,941,463 | A | * | 8/1999 | Herstek et al. | 239/587.1 |
| 6,031,352 | A | * | 2/2000 | Carlson | 318/811 |

* cited by examiner

*Primary Examiner*—Davis Hwu

(57) ABSTRACT

A structurally improved spray gun includes a hollow housing having a hollow handle, an electromagnet in the housing to acturate an oscillating armature which repeatedly impinges a piston in a cylinder to aspirate the paint from a container into the cylinder to spray out to the atmosphere through a nozzle at front of the cylinder. It is characterized in a locking device which is disposed in the housing beneath the cylinder to lock or unlock the cylinder in a rapid and convenient manner.

2 Claims, 9 Drawing Sheets

STRUCTURALLY IMPROVED SPRAY GUN

BACKGROUND OF THE INVENTION

The present invention relates to spray guns and more particularly to a locking device for spray gun which device facilitates a rapid positioning and readily disassembling of a cylinder inside the spray gun.

Typical spray gun 1 (as shown in FIG. 1) comprises a container 2, a lid 3, a cylinder 4 and a electromagnet 5 inside the housing to actuate an oscillating armature 6 to force a piston 8 moving forward so as to aspirate the paint inside the container 2 into the cylinder 4 spraying out to the atmosphere through a nozzle 11. An adjustable anvil 7 on the right side of the oscillating armature 6 to adjust the oscillating extent of the armature 6. The electromagnet 5 is controlled by a press button 10. Because of the lid 3 is integrated with the cylinder 4, the lid 3 must be secured to the bottom 12 of the housing by screws 9 prior to the assembly of the cylinder 4 into the housing. It is known that after finish of a job, a certain amount of paint may congeal in the cylinder 4. To clean the congealed paint, the cylinder 4 must be disassembled by unfastening a plurality of screws 9. This is wearisome job and waste time.

U.S. Pat. Nos. 3,680,789 and 3,899,134 all adopt fastening means that difficult to assemble or disassemble. And U.S. Pat. Nos. 2,999,646 and 3,445,068 also have the disadvantage of integration of the lid with the housing. It causes more difficult to remove the cylinder out of the spray gun to clean up.

Recently, some of the producers adapt threaded cylinder. But it is still inconvenient.

SUMMARY OF THE PRESENT INVENTION

The present invention has a main object to provide a structurally improved spray gun in which a locking device is provided to facilitate a rapid assembling and/or disassembling the cylinder into the housing of the spray gun and the assembly is rather stable.

Accordingly, the structurally improved spray gun of the present invention comprises a hollow housing with a handle, an electromagnet in the housing operated by a pressbutton switch, an oscillating armature pivoted to a rear side of the electromagnet which actuates the armature to make oscillatory action, an adjustable anvil to control the oscillatory span of the armature, a cylinder disposed in side the housing in which is an elastic no-return cork in front end and an elastic piston in rear end, a nozzle at front end of the cylinder and a lid integrated with the bottom of the cylinder to engage with a container containing the paint. When the armature impinges the piston to move forward, the paint is aspirated from the container into the cylinder and sprayed out to the atmosphere through the nozzle. This disclosure is characterized in that a locking device is provided in the housing make incorporation with the check blocks on the outer periphery of the cylinder so as to facilitate a rapid assembly and/or disassembly of the cylinder into the housing and the assembly is rather stable.

The present invention will become more fully understood by reference to the following detailed description thereof when read in conjunction with the attached drawings.

DETAILED DESCRIPTION OF THE PREFERRED EMBODIMENT

Figure 1:
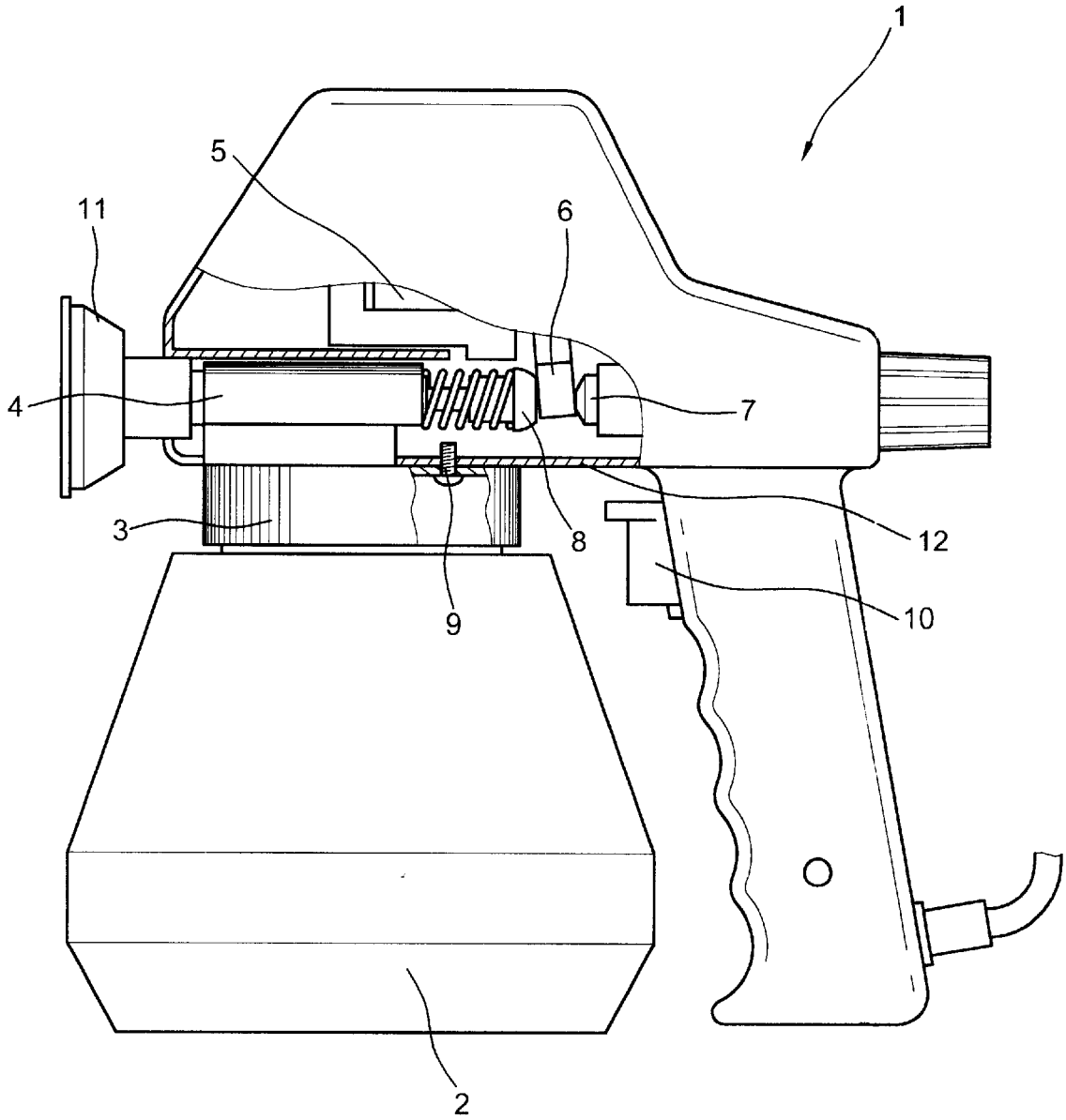
FIG.1 Prior Art
FIG. 1 is a vertical side view to show a spray gun according to a prior art.
Figure 2:
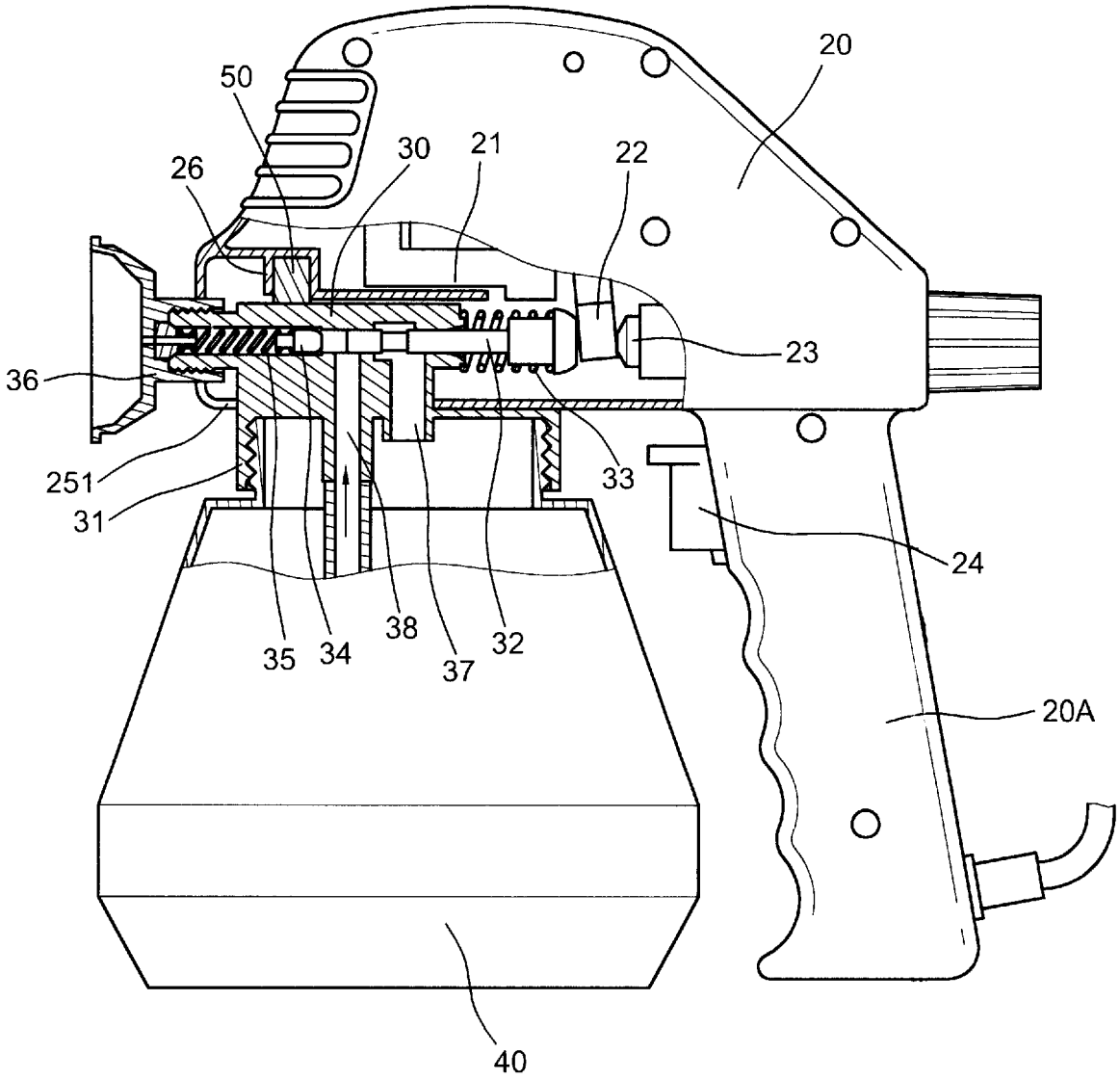
FIG. 2 is a vertical side view and partially sectional view to show a spray gun of the preferred embodiment according to the present invention.
Figure 3:
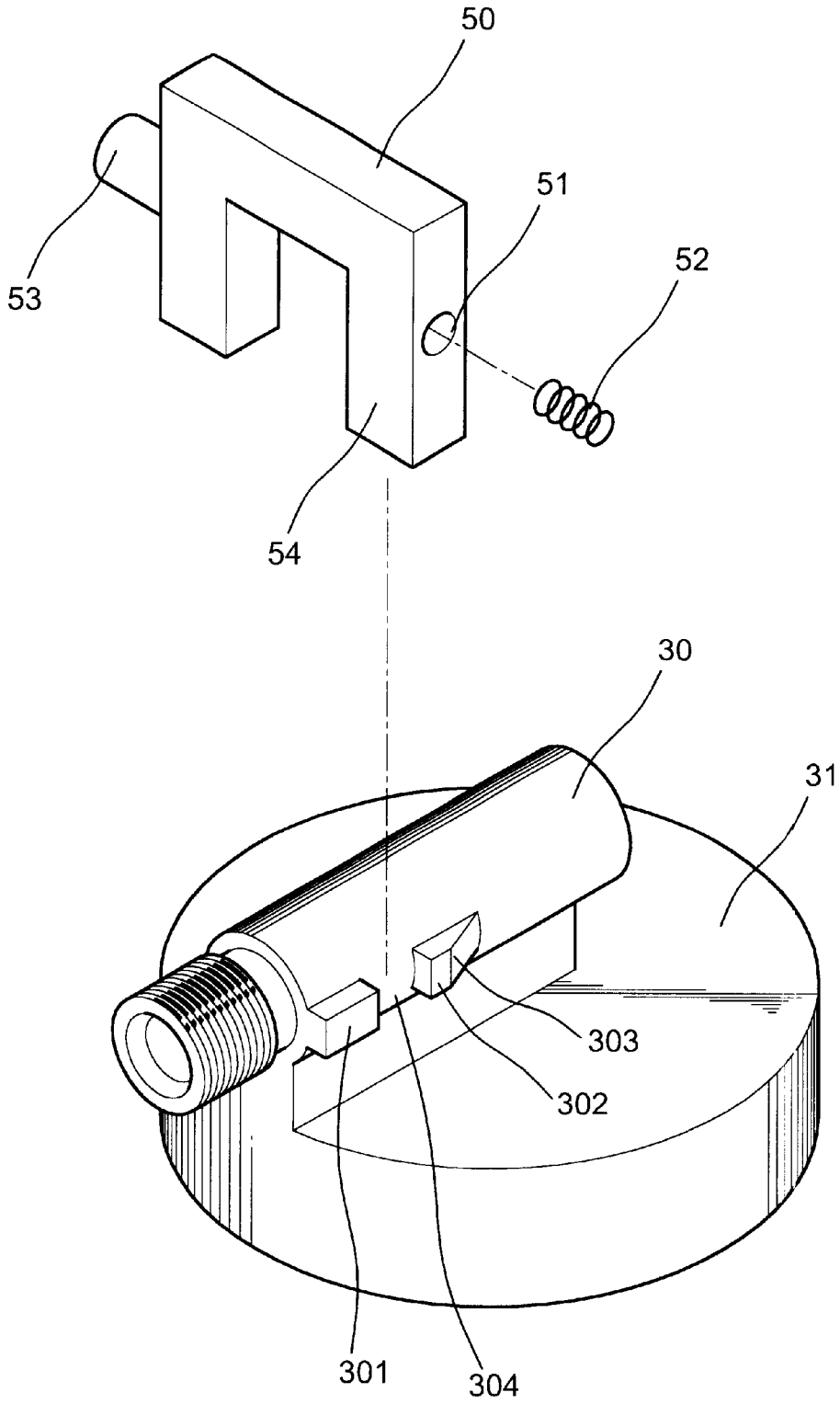
FIG. 3 is an exploded perspective view to show a cylinder and a locking device.
Figure 4:
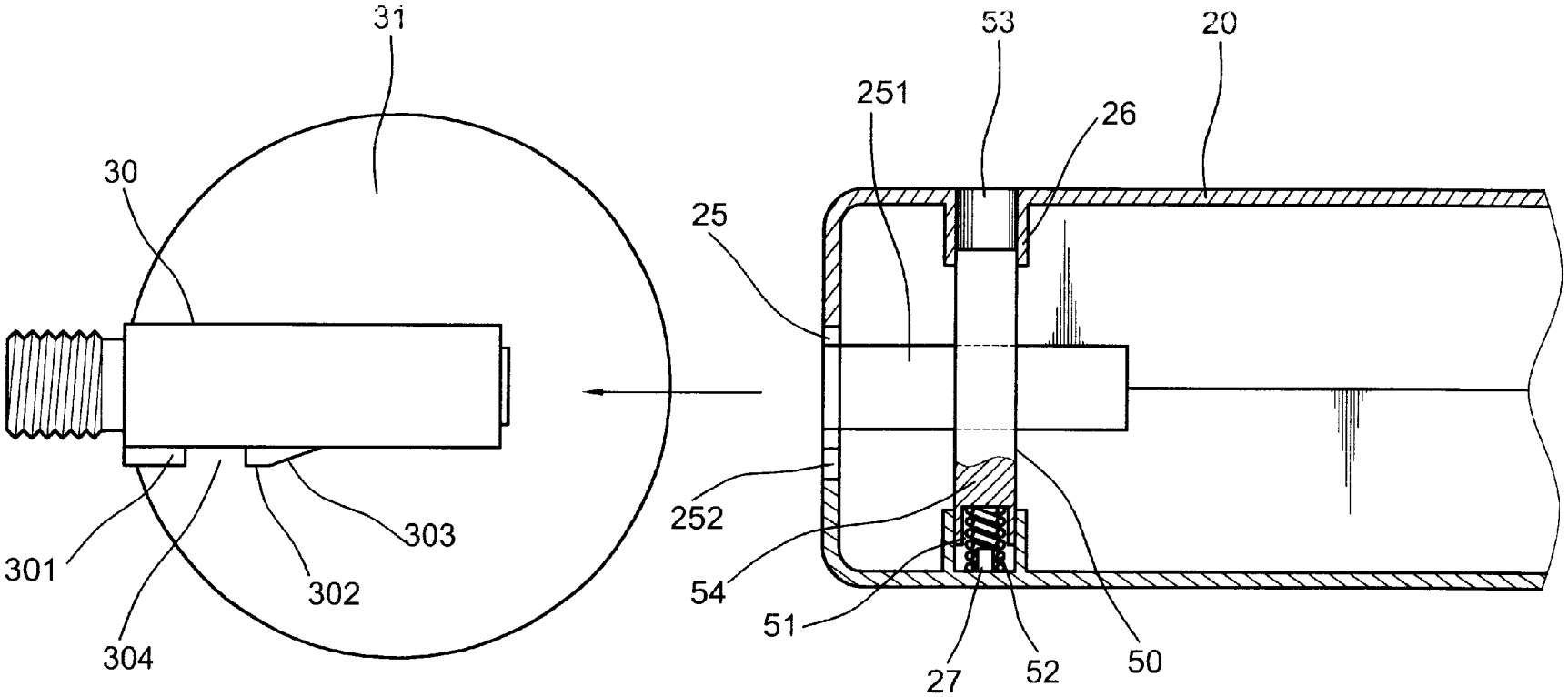
FIG. 4 is a top plane view to show the relationship between the cylinder and the housing.
Figure 5:
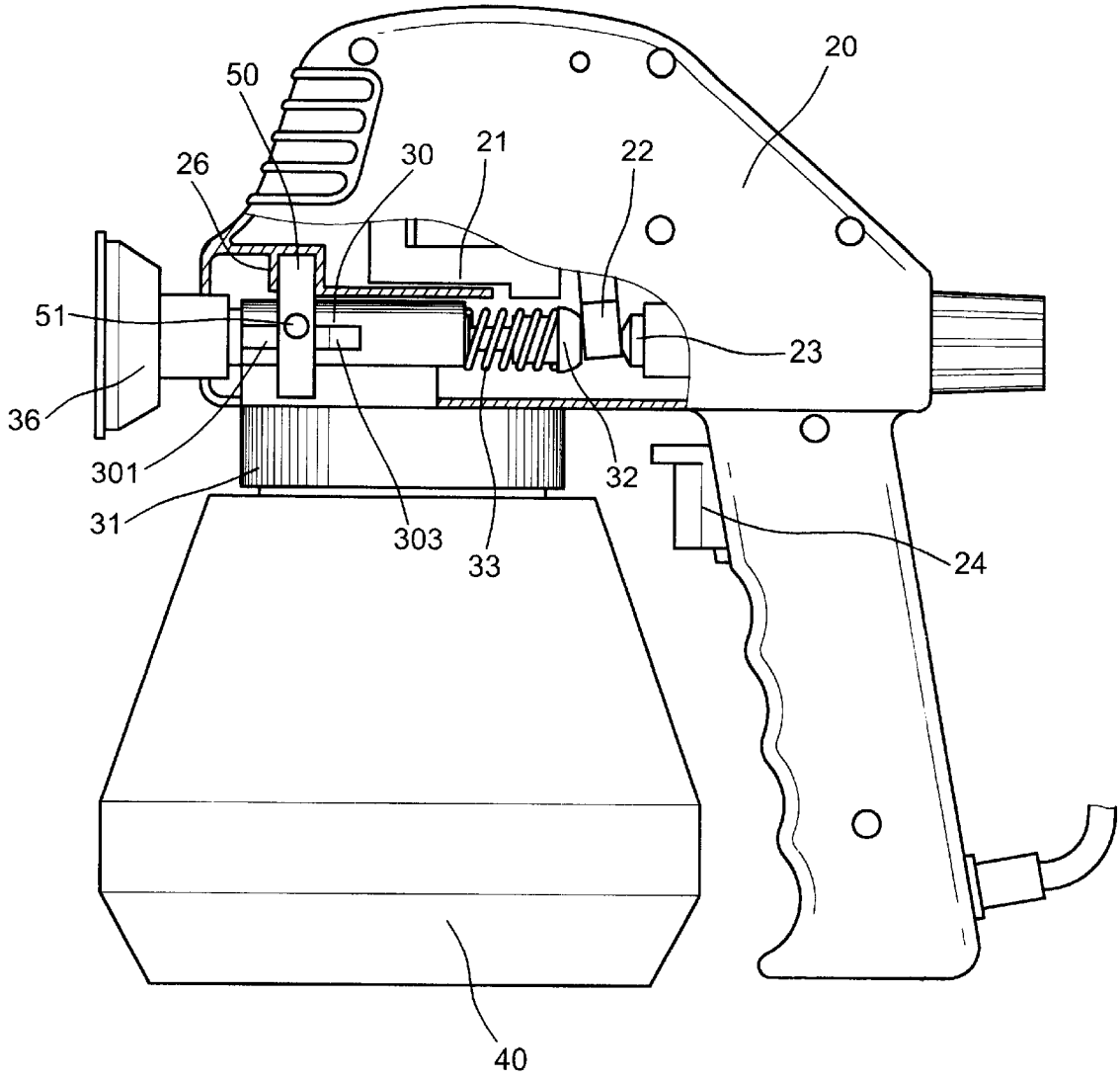
FIG. 5 is a vertical side view to show the assembly of the spray gun of the present invention.
Figure 6:
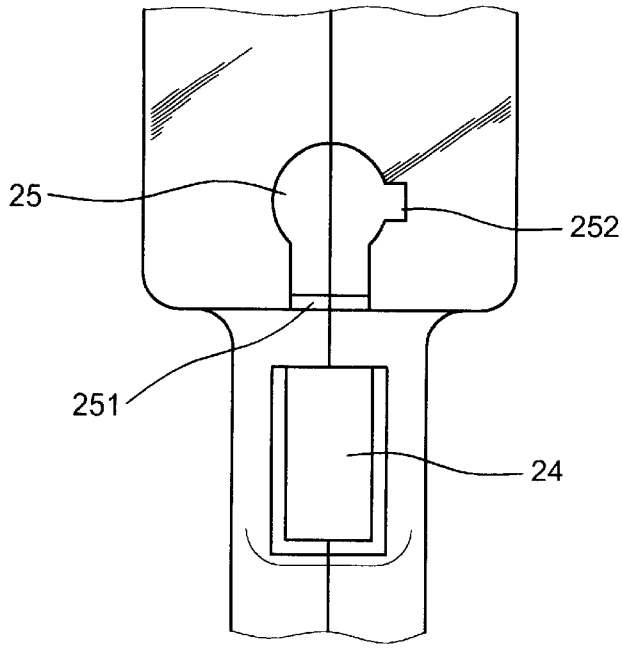
FIG. 6 is a front view of the spray gun of the present invention.

With reference to FIGS. 2 to 5 of the drawings, the spray gun of the present invention comprises a hollow housing 20 having a hollow handle 20A, an electromagnet 21 in the housing 20 operated by a press button switch 24 in the handle, an oscillating armature 22 pivoted to a rear side of the electromagnet 21 and actuated by the electromagnet 21 to perform oscillatory actions, an adjustable anvil 23 which is operated by a swing button to move forward or backward to control the oscillatory span of the armature 22, a cylinder 30 integrated with a internally threaded lid 31 disposed into the housing 20 having in rear end a piston 32 biased by a coil spring 33 and in front end a no-return cork 34 biased by a spring 35, a nozzle 36 screw fastened to the front end thereof, a return pipe 37 and a out pipe 38 spacedly formed under the cylinder 30 and communicated with the cylinder 30 and a container 40 which is screw fastened to the lid 31 for containing the paint. The housing 20 further has an opening 25 in front end integrated with a receiving groove 251 and a rectangular groove 252 (as shown in FIG. 6) and a positioning guide 26.

Figure 7:
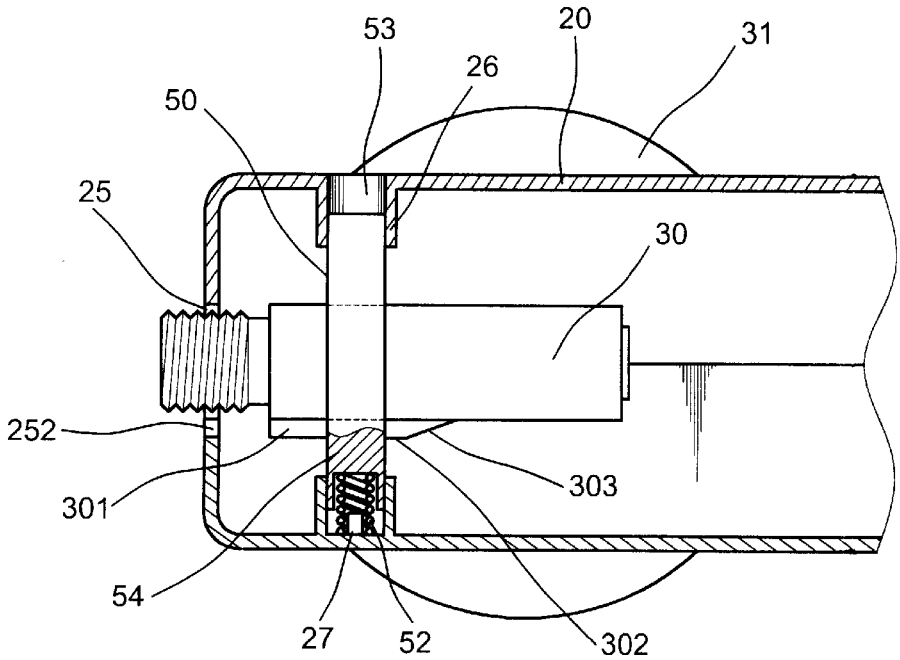
FIG. 7 is a top view to show the assembly of the cylinder with the housing and the locking device.
Figure 8:
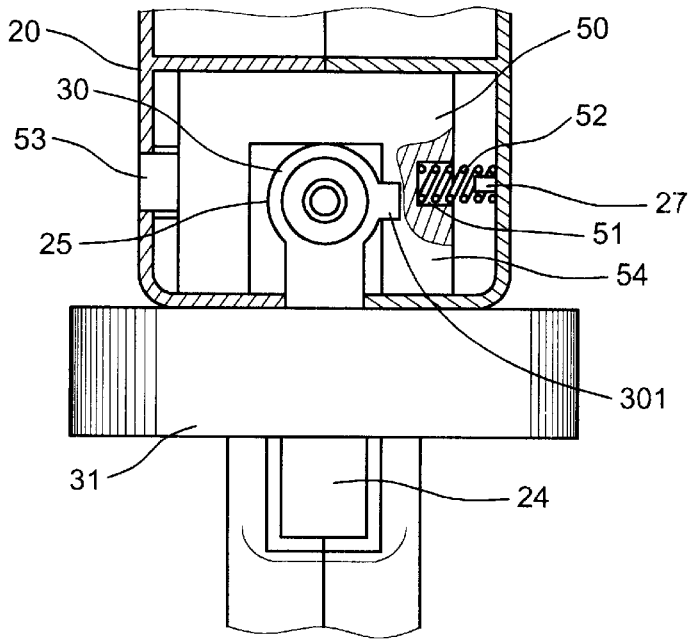
FIG. 8 is a front view and partially sectional view to show the locking device locked the cylinder.
Figure 9:
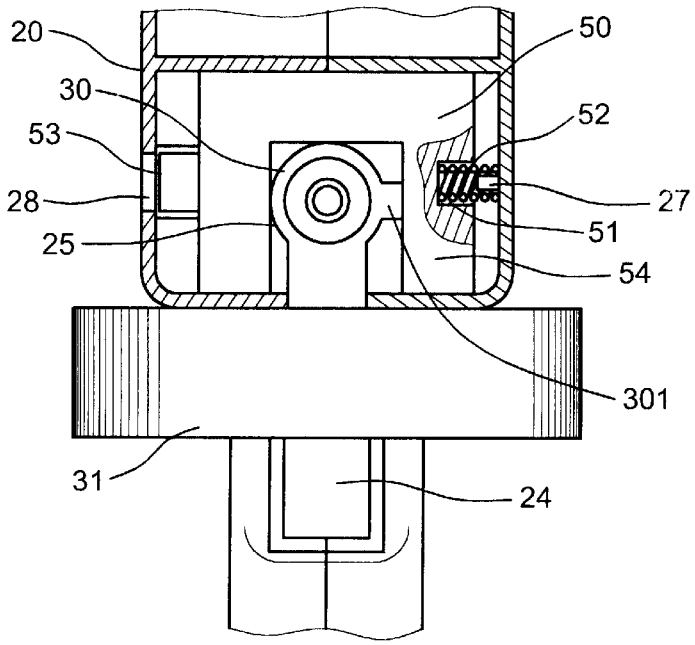
FIG. 9 is a front view and partially sectional view to the locking device unlocked the cylinder.

It is characterized that a locking device 50 is adapted to lock the cylinder 30 inside the housing 20. The locking device 50 is of a inverse U-shaped section and has a positioning aperture 51 in a lateral portion 54 to receive a spring 52 which has other end disposed on a post 27 on an inner wall of the housing 20 and a button 53 on the other side opposite to the aperture 51 disposed in a thru hole 28 (as shown in FIGS. 7, 8 and 9). The locking device 50 is elastic because of the spring 52 and stable because of the positioning guide 26. On a lateral periphery of the cylinder 30, there is a first stop block 301 and a second stop block 302 engageable into the rectangular groove 252 and defined a gap 304 therebetween receivable with the lateral portion 54 of the inverse U-shaped locking device 50, the second stop block 302 has a beveled surface 303 in order that the second stop block 303 can readily pass over the lateral portion 54 which is than engaged into the gap 304 because of the resilience of the spring 52. Therefore the cylinder 30 is firmly locked up without moving transversely. To prevent an inadvertent touching, the button 53 of the locking device 50 is embedded into the thru hole 28 of the housing 20. When presses the button 53 inward, the lateral portion 54 moves laterally to disengaged with the gap 304. So that the cylinder 30 together with the lid 31 enables to draw out of the housing 20. The locking or unlocking of the cylinder 30 is rather rapid without any tool.

In operation, the oscillating armature 22 actuated by the electromagnet 21 performs continuous oscillation to impinge against the piston 32 to move forward and the resilience of the coil spring 33 immediately forces the piston 32 to move backward so that the repeated sliding movement aspirates the paint into the cylinder 30 and then sprays out to the atmosphere through nozzle 36.

Figure 10:
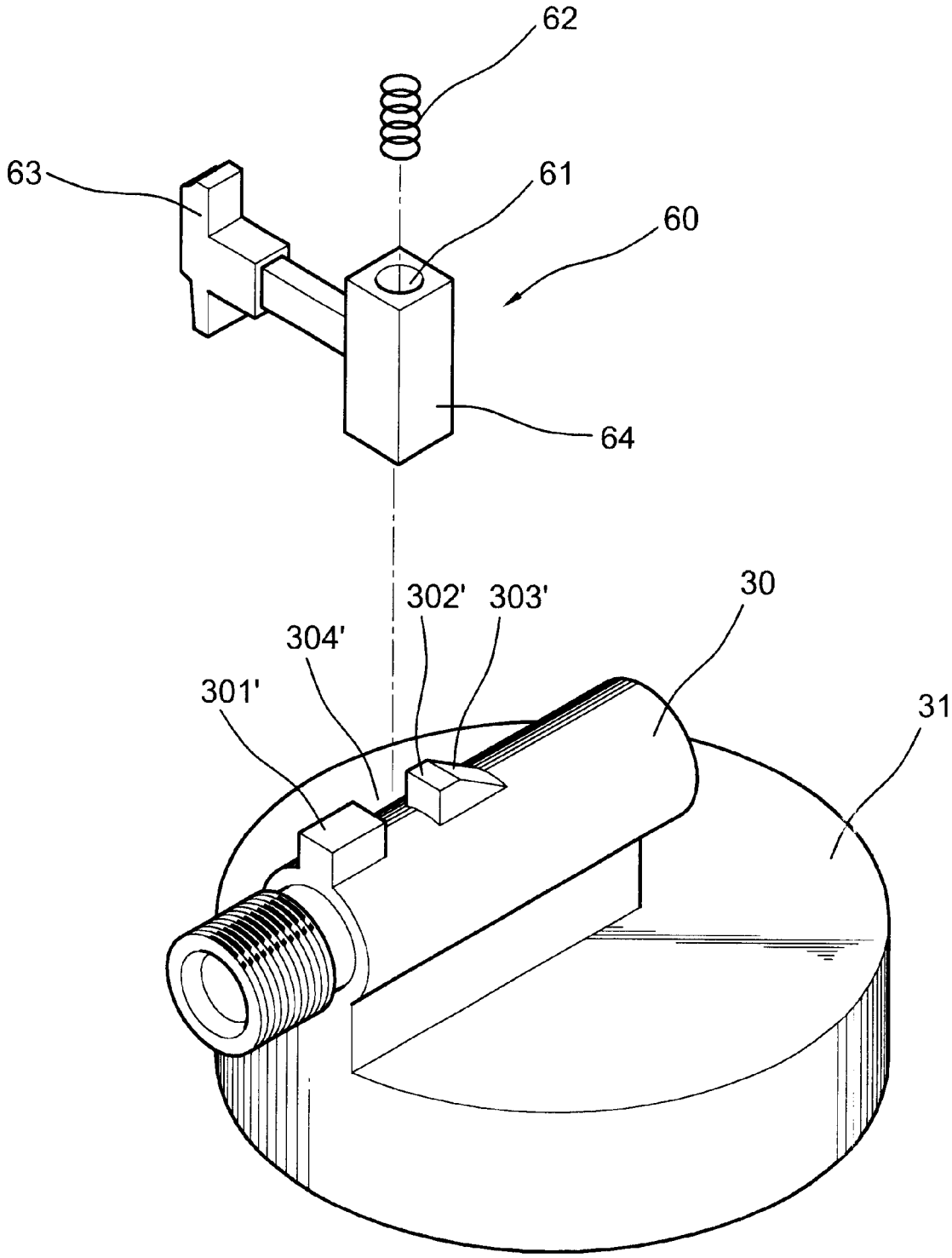
FIG. 10 is an exploded perspective view to show an alternate locking device and an alternate cylinder.
Figure 11:
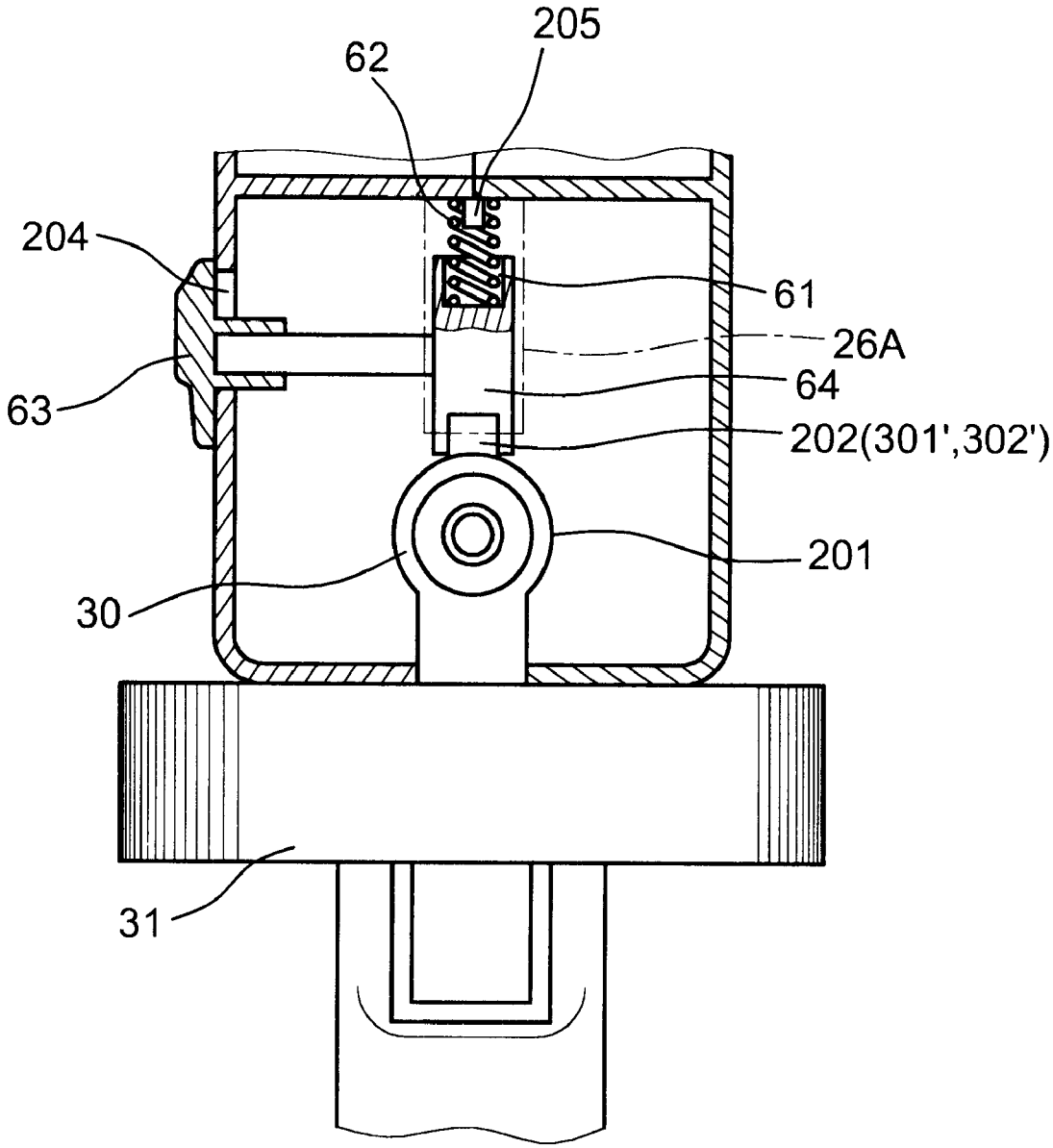
FIG. 11 is a front view and partially sectional view to shown the alternate locking device at a locked position.

Referring to FIGS. 10 and 11 of the drawings, an alternate embodiment of a locking device 60 is provided, the locking device 60 has a vertical rectangular bar 64, an aperture 61 in the top of the bar 64 for engaging one end of a spring 62 which has the other end secured on a post 205 centrally formed on the inner surface of an upper wall of the housing 20 and a sliding button 63 perpendicularly connected to the bar 64 through a transverse rod. To coordinate with, a first stop block 301' and a second stop block 302' now is formed on the top periphery of the cylinder 30 to replace with the stop blocks 301 and 302, a gap 304' is also defined between the blocks 301' and 302' to replace with the gap 304 and is engageable with the bar 64 of the locking device 60. Further, the second slop block 302' has also a beveled surface 303' and in the housing 20, a rectangular groove 252 is moved to the top of the receiving groove 251 and re-designated as 202, the thru hole 28 is now becoming an oblong hole 204 and the positioning guide 26 is now moved to the center of the housing 20 and re-designated a 26A.

When assembling, slide the cylinder 30 into the housing 20 through the receiving groove 201 and the rectangular groove 202, the second stop block 302' will be smoothly passed the rectangular bar 64 of the locking device 60 because of the beveled surface 303' so that the rectangular bar 64 will be automatically engaged into the gap 304' for the resilience of the spring 62. Therefore, the cylinder 30 is firmly locked up. When slides the sliding button 63 upward to have the rectangular bar 64 moving up to disengage with the gap 304', the cylinder 30 is readily drawn out of the housing 20.

The specification relating to the above embodiments should be construed as exemplary rather than as limitative of the present invention, with many variations and modifications being readily attainable by a person of average skill in the art without departing from the spirit or scope thereof as defined by the appended claims and their legal equivalents.

I claim:

1. A locking device for a spray gun comprising:

a hollow housing having a hollow handle, an electromagnet in the housing operated by a pressbutton switch in the handle, an oscillating armature pivoted to a rear side of the electromagnet and actuated by the electromagnet to perform oscillatory actions, an anvil on a rear end of the housing operated by a swing button to move forward and backward for controlling the oscillatory span of the armature, a cylinder integrated with a internally threaded lid disposed into the housing, a container screw fastened to the lid, an out pipe and a return pipe spacedly formed under the cylinder and communicating with the cylinder and the container, a piston inserted into rear end of the cylinder biased by a first spring means, a no-return cork disposed in front end of the cylinder biased by a second spring means, a nozzle screw fastened to the front end of the cylinder, an opening in front end of the housing integrated with a receiving groove and a rectangular groove therein, said rectangular groove positioned at a lateral side of the opening, a post on an inner surface of a side wall of the housing, a thru hole in a side wall of the housing opposite to the post and a positioning guide formed on an inner surface of the side wall of the housing beside the thru hole; said cylinder further having a pair of first and second stop blocks spacedly formed on an outer periphery toward the post defined a gap therebetween and with the second stop block having a beveled surface;

a locking device of inverse U-shaped section disposed into the housing under the cylinder having a first lateral portion including an aperture in an outer surface for engaging with a third spring means which has an outer end disposed on the post and a second lateral portion including a pressbutton disposed into the thru hole opposite to the third spring means; said first lateral portion of said U-shaped locking device being engageable into the gap when the cylinder is sliding in place into the housing.

2. A locking device for a spray gun comprising:

a hollow housing having a hollow handle, an electromagnet in the housing operated by a pressbutton switch in the handle, an oscillating armature pivoted to a rear side of the electromagnet and actuated by the electromagnet to perform oscillatory actions, an anvil on a rear end of the housing operated by a swing button to move forward and backward for controlling the oscillatory span of the armature, a cylinder integrated with a internally threaded lid disposed into the housing, having a first and a second stop blocks spacedly projected on a top to define a gap therebetween with the second stop block having a beveled surface, a container screw fastened to the lid, an out pipe and a return pipe spacedly projected downward from the cylinder and communicating to the cylinder and the container, a piston inserted into rear end of the cylinder biased by a first spring means, a no-return cork disposed in front end of the cylinder biased by a second spring means, a nozzle screw fastened to the front end of the cylinder, an opening in front end of the housing integrated with a rectangular groove on top of the opening, a post projected downward from an inner surface of a top wall of the housing directed to the gap of the cylinder including a positioning guide on lateral sides thereof and an oblong hole in a side wall of the housing;

a locking device disposed into the housing above the cylinder having a rectangular bar engageable into the gap and slidable in the positioning guide, said bar having an aperture in a top for receiving one end of a third spring means which has other end disposed on the post and a sliding button slidably disposed outside of the oblong hole and connected to the bar through a transverse rod.

* * * * *